US009190705B2

(12) United States Patent
Wu et al.

(10) Patent No.: US 9,190,705 B2
(45) Date of Patent: Nov. 17, 2015

(54) DUAL MODE DIELECTRIC RESONATOR FILTER HAVING PLURAL HOLES FORMED THEREIN FOR RECEIVING TUNING AND COUPLING SCREWS

(71) Applicant: The Chinese University of Hong Kong, Hong Kong (CN)

(72) Inventors: Ke-Li Wu, Hong Kong (CN); Hai Hu, Hong Kong (CN)

(73) Assignee: The Chinese University of Hong Kong, Hong Kong (CN)

( * ) Notice: Subject to any disclaimer, the term of this patent is extended or adjusted under 35 U.S.C. 154(b) by 204 days.

(21) Appl. No.: 13/849,286

(22) Filed: Mar. 22, 2013

(65) Prior Publication Data

US 2013/0249651 A1 Sep. 26, 2013

Related U.S. Application Data

(60) Provisional application No. 61/615,728, filed on Mar. 26, 2012.

(51) Int. Cl.

| | |
|---|---|
| ***H01P 1/20*** | (2006.01) |
| ***H01P 7/10*** | (2006.01) |
| ***H01P 1/213*** | (2006.01) |
| ***H01P 1/208*** | (2006.01) |

(52) U.S. Cl.

CPC ..... *H01P 7/10* (2013.01); *H01P 1/2084* (2013.01); *H01P 1/2086* (2013.01); *H01P 1/213* (2013.01); *H01P 7/105* (2013.01)

(58) Field of Classification Search

CPC ..... H01P 1/2084; H01P 1/2086; H01P 7/10; H01P 7/105; H01P 1/213

USPC ..... 333/202, 235, 134

See application file for complete search history.

(56) References Cited

U.S. PATENT DOCUMENTS 4,051,447 A * 9/1977 Heckman, Jr. ..... 333/24 R
4,639,699 A * 1/1987 Nishikawa et al. ..... 333/202

(Continued)

FOREIGN PATENT DOCUMENTS

CN 1254965 A 5/2000
CN 101895004 A 11/2010

OTHER PUBLICATIONS

Wu et al., "Dielectric Resonator Filters, Methods of Manufacturing the Same and Diplexer/Multiplexers Using Dielectric Resonator Filters," U.S. Appl. No. 61/615,728, filed Mar. 26, 2012, 35 pages.

*Primary Examiner* — Benny Lee
(74) *Attorney, Agent, or Firm* — Seed IP Law Group PLLC

(57) ABSTRACT

A dielectric resonator filter and a method of manufacturing the same are disclosed. The dielectric resonator includes a metal housing having a top surface and a bottom surface and defining a resonator cavity, and a dielectric rod located within the resonator cavity. The dielectric rod is short-circuited at both the top surface and the bottom surface. A plurality of holes are formed in the dielectric rod parallel to an axis of the dielectric rod and a plurality of apertures are formed on the top surface corresponding to the positions of the holes, respectively. A plurality of screws are inserted into the holes through the apertures, respectively. The dielectric resonator supports dual $TM_{11}$ degenerate modes, each of which forms a resonant circuit. An insertion depth and a dimension of each of the screws is adjustable to adjust resonance frequencies of the dual degenerate modes and coupling between the dual degenerate modes.

26 Claims, 16 Drawing Sheets

(56) References Cited

U.S. PATENT DOCUMENTS 6,320,484 B1 * 11/2001 Furuya et al. ..... 333/219.1
6,414,571 B1 7/2002 Hunter et al.
8,111,115 B2 2/2012 Mansour et al.
2002/0186103 A1 * 12/2002 Ando et al. ..... 333/202
2004/0041667 A1 * 3/2004 Yi et al. ..... 333/202

* cited by examiner

DUAL MODE DIELECTRIC RESONATOR FILTER HAVING PLURAL HOLES FORMED THEREIN FOR RECEIVING TUNING AND COUPLING SCREWS

BACKGROUND

Dielectric resonator filters have been widely employed in space payloads and cellular base station equipment due to their compact size, good thermal stability and high Q performance.

Single-mode dielectric resonator filters, which have advantages in manufacturability and filter coupling configurations, have been widely used in wireless industry.

In recent years, multiple degenerate mode resonances in a dielectric resonator have also been explored, which utilize either the same type of modes with certain spatial symmetries or different types of modes resonating at the same frequency. U.S. Pat. No. 6,414,571 discloses a dual TM mode composite resonator for use in devices operating at microwave frequencies in the field of cellular telecommunications. U.S. Pat. No. 8,111,115 discloses dielectric resonator filters and multiplexers realized using full cylindrical or half-cut dielectric resonators.

SUMMARY OF THE INVENTION

One aspect of the disclosure is to provide a dielectric resonator filter. The dielectric resonator filter includes at least one dielectric resonator. The dielectric resonator includes a metal housing having a top surface and a bottom surface and defining a resonator cavity, and a dielectric rod located within the resonator cavity. The dielectric rod is short-circuited at both the top surface and the bottom surface. A plurality of holes are formed in the dielectric rod parallel to an axis of the dielectric rod and a plurality of apertures are formed on the top surface corresponding to the positions of the holes, respectively. A plurality of screws are inserted into the holes through the apertures, respectively. The dielectric resonator supports dual $TM_{11}$ degenerate modes, each of which forms a resonant circuit. An insertion depth of each of the screws is adjustable for adjusting resonance frequencies of the dual degenerate modes and coupling between the dual degenerate modes.

One aspect of the disclosure is to provide a dielectric resonator filter. The dielectric resonator filter includes a plurality of dielectric resonators in a common housing, wherein the housing includes a top surface and a bottom surface. A separating wall is provided between each of two adjacent dielectric resonators to separate the housing into a plurality of resonator cavities. A coupling element is provided for coupling between two adjacent dielectric resonators. Each of the dielectric resonator comprises a dielectric rod located within the resonator cavity of the dielectric resonator, wherein the dielectric rod is short-circuited at both the top surface and the bottom surface; a plurality of holes are formed in the dielectric rod parallel to an axis of the dielectric rod and a plurality of apertures are formed on the top surface corresponding to the positions of the holes, respectively, a plurality of screws are inserted into the holes through the apertures, respectively. Each of the dielectric resonators supports dual $TM_{11}$ degenerate modes, each of which forms a resonant circuit, and an insertion depth of each of the screws is adjustable for adjusting resonance frequencies of the dual degenerate modes and coupling between the dual degenerate modes.

Another aspect of the disclosure is to provide a method of manufacturing a dielectric resonator filter. The method includes obtaining dimension parameters of the dielectric rod and the metal housing of the filter based on required center frequency, bandwidth, transmission and return loss; forming the dielectric rod with holes, the screws, the metal housing and the top surface of the metal housing with apertures according to the obtained dimension parameters; and assembling the filter by disposing the dielectric rods into the metal housing and inserting the screws into the holes of the dielectric rods. The dielectric resonator filter supports dual $TM_{11}$ degenerate modes, each of which forms a resonant circuit, and an insertion depth of each of the screws is adjustable for adjusting resonance frequencies of the dual degenerate modes and coupling between the dual degenerate modes.

DETAILED DESCRIPTION OF THE INVENTION

Figure 1:
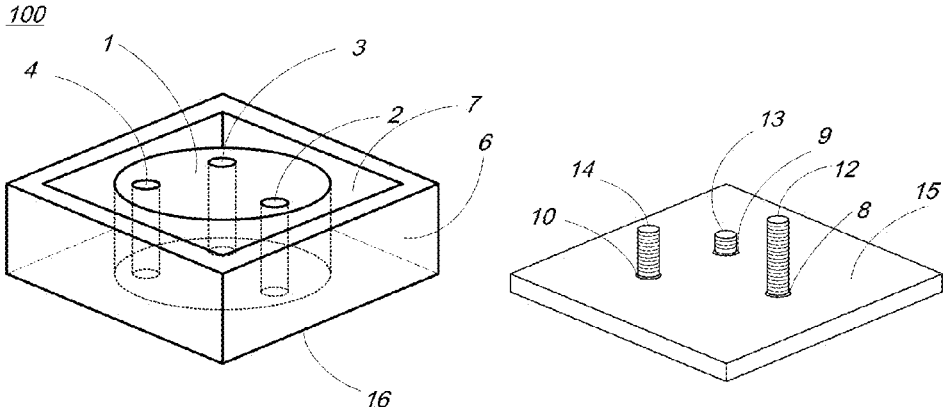
FIG. 1 is a perspective view of a dielectric resonator filter including a dielectric resonator according to an embodiment of the present application.

Hereinafter, a detailed description will be given with reference to the appended drawings, where like features in the drawings are designated by the same reference numbers.

According to an embodiment of the present application, FIGS. 1 and 2*a*-2*c* show a dielectric resonator filter including a dielectric resonator 100. The dielectric resonator 100 includes a metal housing 6 defining a resonator cavity 7. The metal housing 6 includes a top surface 15 and a bottom surface 16. A dielectric rod 1 is located within the resonator cavity 7. The dielectric rod 1 is a full height dielectric rod situated in the cavity 7. That is, the rod 1 is short-circuited at both the top surface 15 and the bottom surface 16. Holes 2, 3, 4 are formed in the dielectric rod parallel to an axis of the dielectric rod 1 and apertures 8, 9, 10 are formed on the top surface 15 corresponding to the positions of the holes 2, 3, 4, respectively. Screws 12, 13, 14 are inserted into the holes 2, 3, 4 through the apertures 8, 9, 10, respectively. The dielectric resonator 100 supports dual $TM_{11}$ degenerate modes, each of which forms a resonant circuit. A dual mode resonator works by coupling energy from one mode to its degenerate mode in the same resonator. In the embodiment, an insertion depth of each of the screws 12, 13, 14 is adjustable for tuning the coupling between the dual degenerate modes and adjusting resonance frequencies of the dual degenerate modes.

According to an embodiment, the holes formed in the dielectric rod include one coupling screw hole 2 sized and dimensioned for accommodating coupling screw 12 (e.g., threaded) and two tuning screw holes 3, 4 for accommodating tuning screws 13, 14 (e.g., threaded). In an example, the holes 2, 3, 4 are through holes formed in the rod 1. In another example, the holes 2, 3, 4 can be non-through holes. In an example, the diameter c (FIG. 2*a*) of the tuning screws can be chosen by a tradeoff between the mechanical manufacturability and the filter tunability. If the diameter c is increased, the tuning and coupling capability of the screw will be increased.

According to an embodiment, as shown in FIG. 1, the resonator cavity 7 is a square resonator cavity and the dielectric rod 1 is a cylindrical dielectric rod situated in the center of the resonator cavity.

Figure 3A:
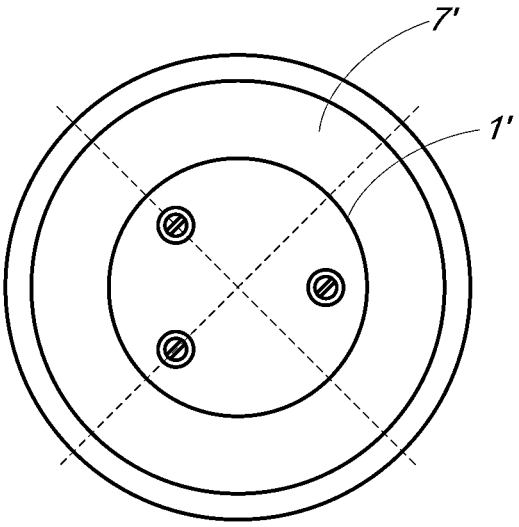
FIG. 3*a* is a plan view of a dielectric resonator according to an embodiment of the present application.

According to another embodiment, as shown in FIG. 3*a*, the resonator cavity 7' is a cylindrical resonator cavity and the dielectric rod 1' is a cylindrical dielectric rod situated in the center of the resonator cavity.

Figure 3B:
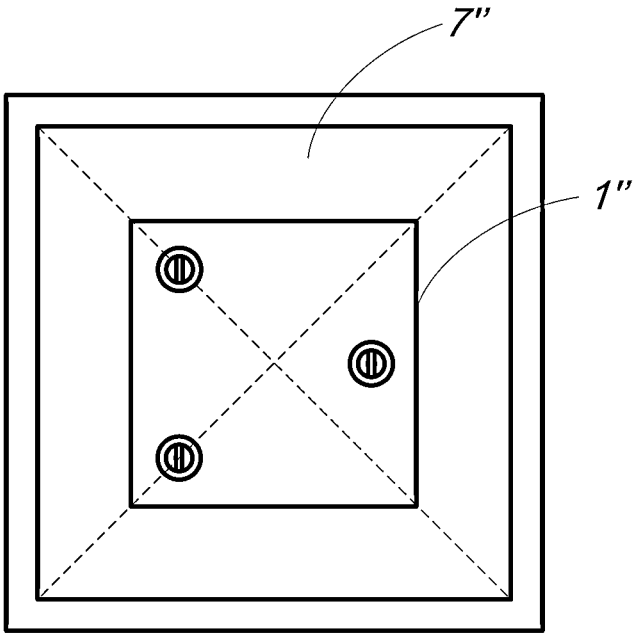
FIG. 3*b* is a plan view of a dielectric resonator according to an embodiment of the present application.

According to an embodiment, as shown in FIG. 3*b*, the resonator cavity 7" is a square resonator cavity and the dielectric rod 1" is a square dielectric rod situated in the center of the resonator cavity.

The behavior of the resonator 100 will be described with reference to FIGS. 4*a*, 4*b*, and 4*c*.

Figure 4A:
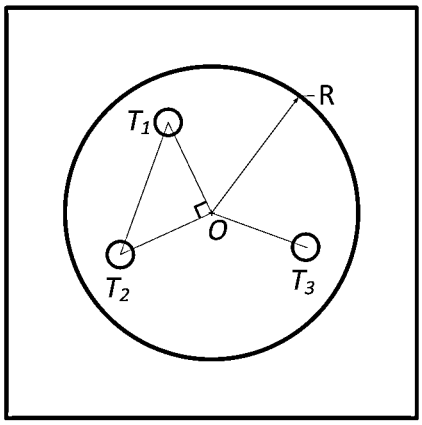
FIG. 4*a* is a schematic view showing the arrangement of the screws according to an embodiment of the present application.

FIG. 4*a* is a schematic view showing the arrangement of the screws/holes according to an embodiment of the present application. Here, a resonator having a square metal housing with a cylindrical dielectric rod is taken as an example, but the design principles can also be used in the other resonators as shown in FIGS. 3*a* and 3*b*.

As shown in FIG. 4*a*, R is the radius of the dielectric rod, point O is the resonator center, $T_1$ and $T_2$ are the positions for the two tuning screws, respectively (to tune an individual dual $TM_{11}$ resonance frequency), and $T_3$ is the position for the coupling screw (to couple the dual $TM_{11}$ modes).

According to an embodiment, to effectively and independently realize the tuning and coupling functions, the positions of $T_1$, $T_2$ and $T_3$ can be designed as: line $OT_1$ is perpendicular to line $OT_2$; line $OT_3$ is either perpendicular to line $T_1T_2$ or be parallel to it; the length of lines $OT_1$, $OT_2$ and $OT_3$ is between 0.5 R to 0.8 R.

In an embodiment, to facilitate the filter routing and manufacture, $T_1$, $T_2$ and $T_3$ can be arranged on a same circle that is concentric with dielectric rod.

Figure 4B:
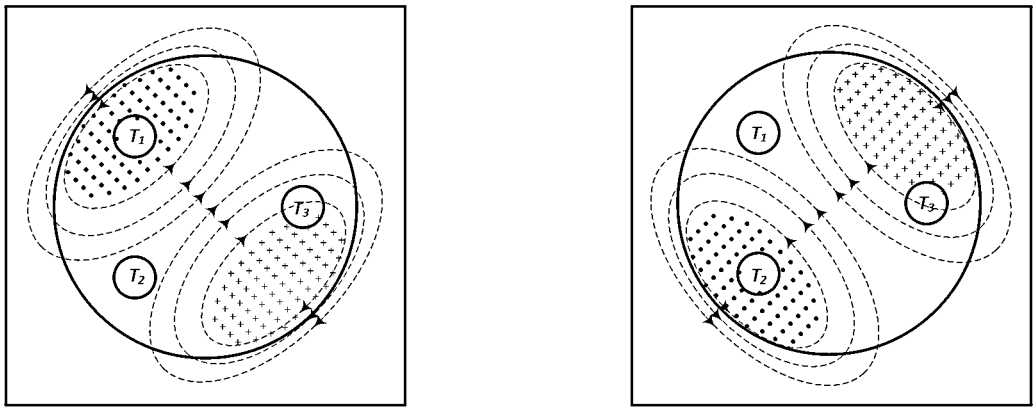
FIG. 4*b* is a schematic view showing the electric and magnetic field of the two $TM_{11}$ degenerate modes in a resonator according to an embodiment of the present application.

In an example, positions $T_1$ and $T_2$ for tuning screws can be laid along the diagonal lines of the resonator cavity, with the resultant EM fields of a pair of orthogonal degenerate $TM_{11}$ modes as shown in FIG. 4*b*. The dots and crosses represent the electric field, which go into and out of the screen. The dashed lines represent the magnetic field. One of the modes is called h-mode (left), and the other is called v-mode (right) as shown in FIG. 4*b*.

Figure 4C:
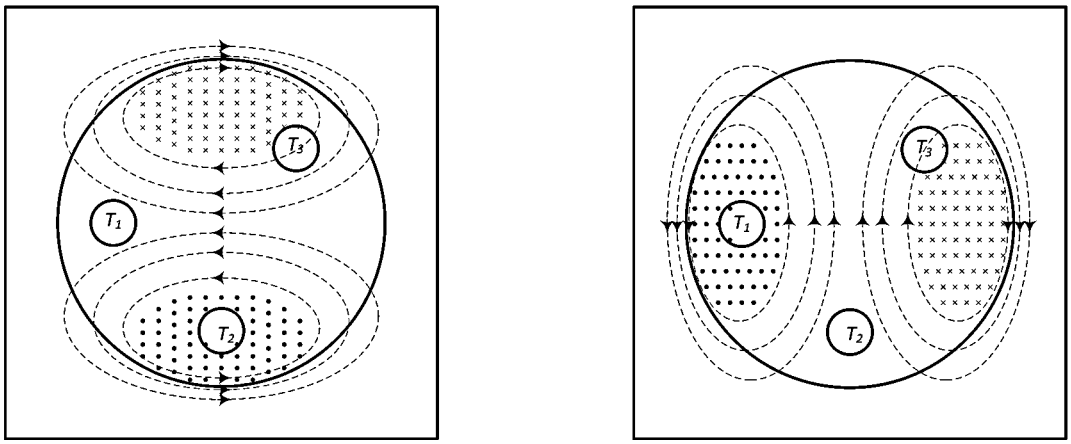
FIG. 4*c* is a schematic view showing the electric and magnetic field of the two $TM_{11}$ degenerate modes in a resonator according to an embodiment of the present application.

In another example, positions $T_1$ and $T_2$ for tuning screws can follow the cavity side line directions, with the resultant EM fields of the resonator shown in FIG. 4*c*. The dots and crosses represent the electric field, which go into and out of the screen. The dashed lines represent the magnetic field. One of the modes is called h-mode (left), the other is called v-mode (right).

Figure 2A:
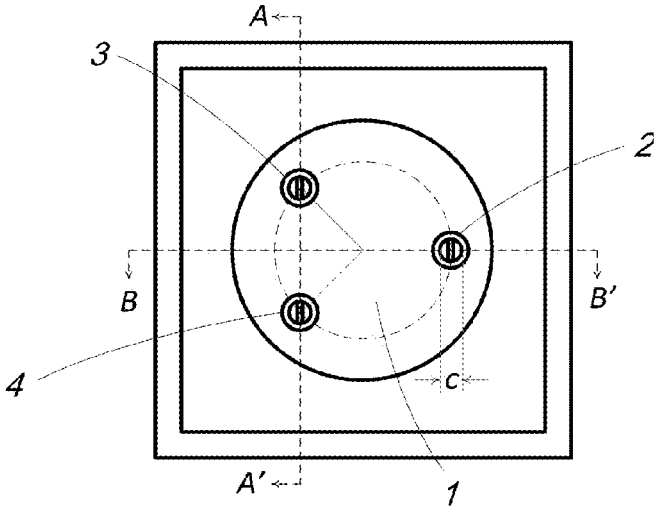
FIG. 2*a* is a plan view of a dielectric resonator according to an embodiment of the present application.
Figure 2B:
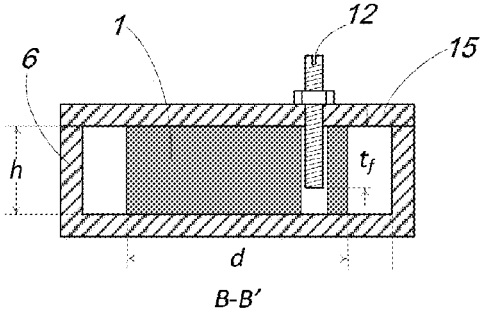
FIG. 2*b* is a cross-sectional view along a line B-B' of FIG. 2*a*.
Figure 2C:
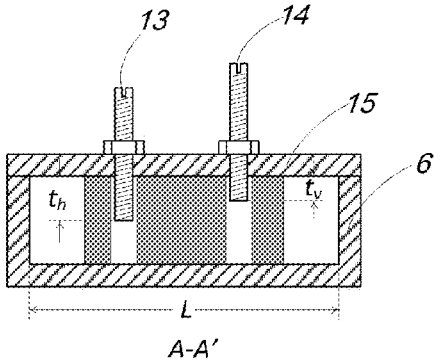
FIG. 2*c* is a cross-sectional view along a line A-A' of FIG. 2*a*.

In an embodiment, the resonance frequencies of the h-mode and the v-mode can be adjusted by adjusting the insertion depths of the tuning screws located in positions $T_1$ and $T_2$, respectively. The coupling between the h-mode and the v-mode can be adjusted by adjusting the insertion depth of the coupling screw located in position $T_3$. For example, as shown in FIGS. 2*b* and 2*c*, the insertion depth $t_h$ (FIG. 2*c*) of the tuning screw 13 inserted into the tuning screw hole 3 can be adjusted for tuning the resonance frequency of the h-mode and the insertion depth $t_v$ (FIG. 2*c*) of the tuning screw 14 inserted into the tuning screw hole 4 can be adjusted for tuning the resonance frequency of the v-mode. In addition, the insertion depth $t_f$ (FIG. 2*b*) of the coupling screw 12 inserted into the coupling screw hole 2 can be adjusted for coupling between the h-mode and the v-mode. Thus, the resonance frequencies of the dual modes and mutual coupling can be adjusted independently. Also, the tuning of both the resonant frequencies and the coupling can be accessible in a convenient way, i.e., from the top of the filter. That is, all the tuning/coupling structures can be realized by mechanical elements adjustable on the top surface of the dual mode filter.

Figure 5:
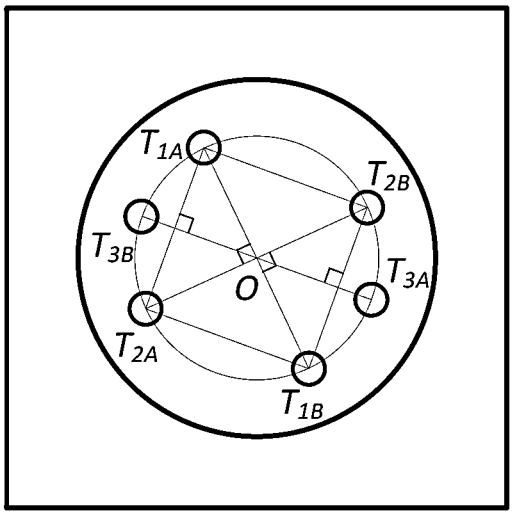
FIG. 5 is a schematic view showing an arrangement of the screws according to an embodiment of the present application.

In the above, a dielectric resonator with two tuning screws and one coupling screw is described. However, the arrangement of the screws of the dielectric resonator of the present application is not limited to this, only if at least one screw is positioned to tune the h-mode, at least one screw is positioned to tune the v-mode, and at least one screw is positioned to couple the h-mode and the v-mode. For example, as shown in FIG. 5, six screws are provided in the dielectric resonator. Locations $T_{1A}$, $T_{1B}$ represent the tuning screws/holes for h-mode, $T_{2A}$ and $T_{2B}$ represent the tuning screws/holes for v-mode, and locations $T_{3A}$ and $T_{3B}$ represent the tuning screws/holes for two coupling screws/holes which couple the two modes (resonances) in the same dielectric resonator. In an embodiment, the six holes can be positioned substantially on a same circle that is concentric with the dielectric rod. The line $T_{1A}T_{1B}$ is perpendicular to line $T_{2A}T_{2B}$ and the line $T_{3A}T_{3B}$ is either perpendicular to line $T_{1A}T_{2A}$, or in parallel with line $T_{1A}T_{2A}$.

Figure 6:
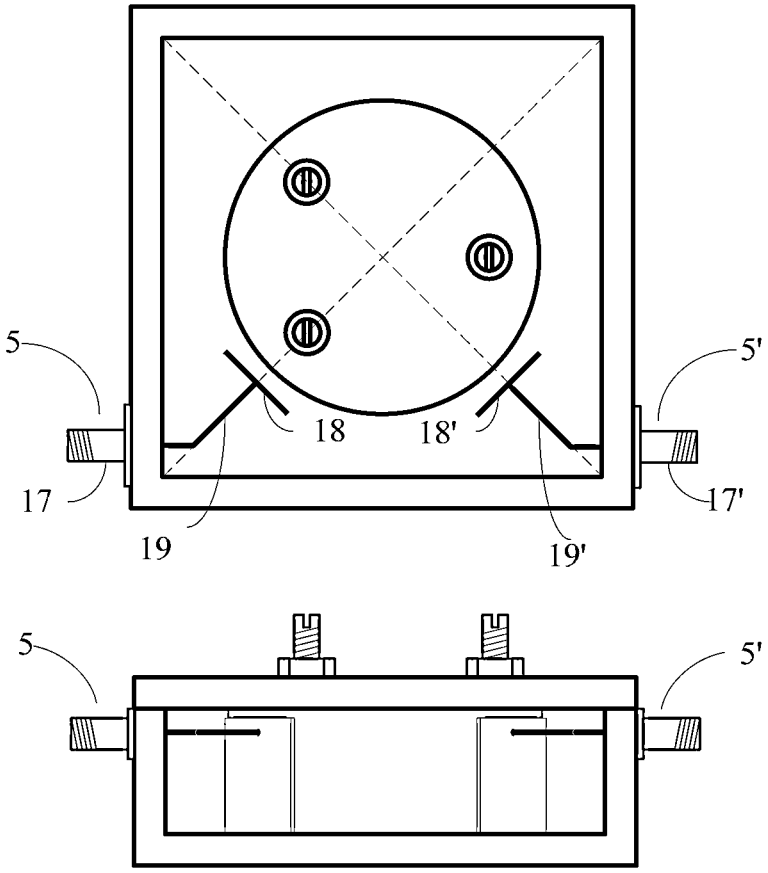
FIG. 6 is a schematic view showing a filter with an input/output according to an embodiment of the present application.

According to an embodiment, as shown in FIG. 6, an input element 5 and an output element 5' are provided in the filter with the dielectric resonator 100 for realizing the input and output coupling between the filter and other apparatus, respectively. The input/output 5/5' includes a connector 17/17', an input/output coupling strip 18/18', and a wire 19/19'. In an example, the input/output coupling strip 18/18' has an end connected to the SMA connector 17/17' through the wire 19/19', and another end grounded to the bottom surface 16. By designing the distance between the coupling strip 18/18' and the dielectric rod, the required I/O coupling can be achieved.

According to an embodiment, the filter may comprise a plurality of dielectric resonators.

Figure 7A:
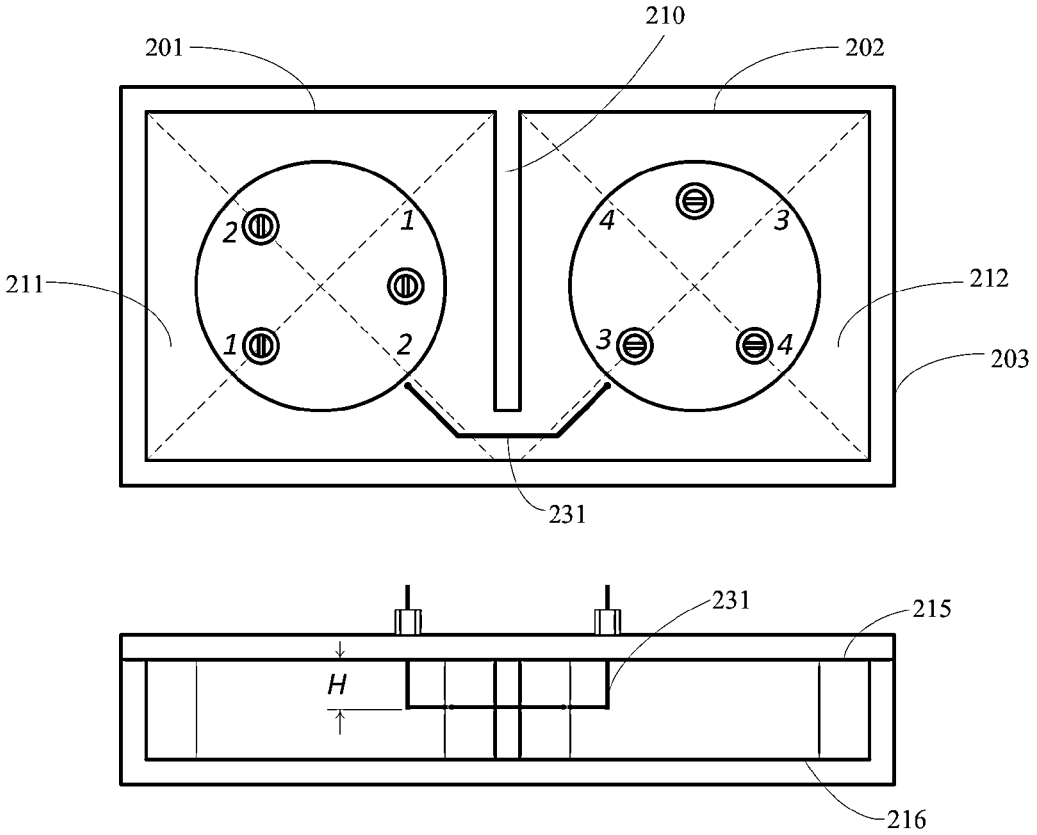
FIG. 7*a* is a schematic view showing a filter with two dielectric resonators according to an embodiment of the present application.

As shown in FIG. 7*a*, the filter comprises a first resonator 201 and a second resonator 202 in a common housing 203 with a top surface 215 and a bottom surface 216. A separating wall 210 is positioned between the two resonators to separate the housing 203 into two resonator cavities 211, 212. Each of the dielectric resonators includes a cylindrical dielectric rod with three holes for accommodating two tuning screws and one coupling screw, which supports dual $TM_{11}$ degenerate modes. The screws of a resonator are adjustable for adjusting resonance frequencies of the dual degenerate modes and the coupling between the dual degenerate modes of the resonator. In order to efficiently use the space of the metal cavity for realizing the couplings between two dielectric resonators and reduce the stray coupling between two metal cavities, in an embodiment, the two frequency tuning screws of a resonator cavity are placed along the two diagonal lines (i.e., dashed lines 1 and 2 for the first resonator 201 and dashed lines 3 and 4 for the second resonator 202) of the resonator cavity.

In order to realize the coupling between the dielectric resonator 201 and the dielectric resonator 202, according to an embodiment, a coupling element 231 is provided as shown in FIG. 7*a*. In an embodiment, the coupling element 231 is a conductor loop for realizing an inter-cavity coupling for the dual mode $TM_{11}$ dielectric resonator filter. The loop 231 is formed by a metal wire with one end connected to the upper surface of the resonator cavity 211 and the other end connected to the upper surface of the resonator cavity 212.

In an example, as shown in FIG. 7*a*, the coupling element 231 is a loop in a trapezoid shape.

Figure 7B:
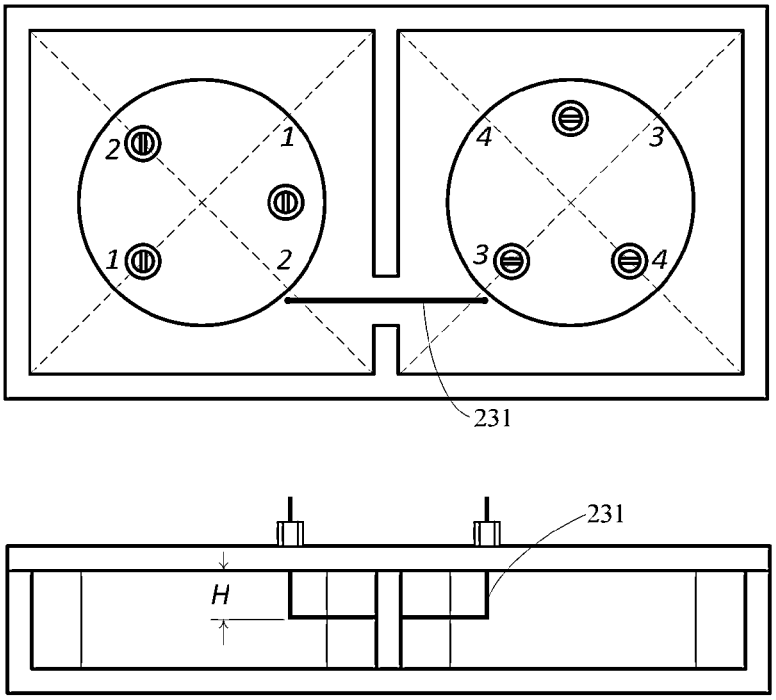
FIG. 7*b* is a schematic view showing a filter with two dielectric resonators according to another embodiment of the present application.

In another example, as shown in FIG. 7*b*, the coupling element 231 is a loop in a rectangular shape. This structure provides a convenient means for volume manufacturing and tuning without noticeable stray couplings.

The inter-cavity coupling structure can be controlled by changing the height H of the loop. By pulling up or pushing down the pair of straight wires forming the coupling loop outside of the top surface of the resonator cavity, the coupling between resonators 201 and 202 can be reduced or increased.

Figure 8:
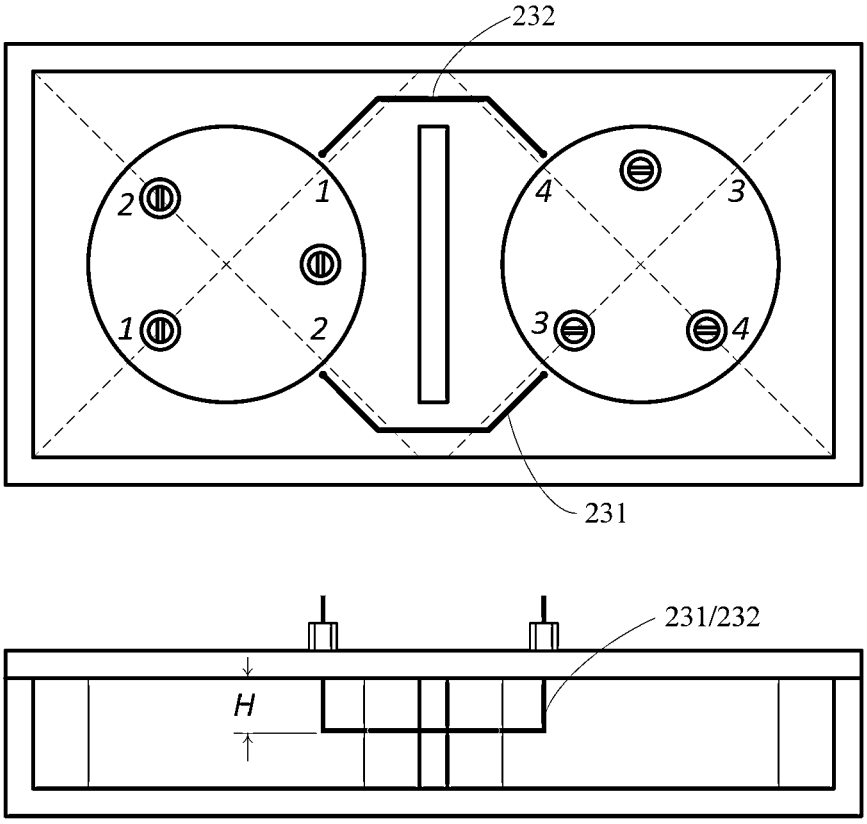
FIG. 8 is a schematic view showing a filter with two dielectric resonators according to an embodiment of the present application.

According to an embodiment, more than one coupling element can be provided for coupling the resonators. As shown in FIG. 8, two coupling elements 231, 232 are disposed between the two adjacent dielectric resonators for coupling the resonators. Since the degenerate mode coupling screws of the adjacent dielectric rods excite two pairs of oppositely polarized v and h modes in each individual cavity, the inter-cavity couplings realized by the two loops are in opposite signs, which may result in a pair of symmetric transmission zeroes on both sides of a filter rejection band.

By choosing the number, the layout and the coupling manner of resonators in the filter, it is possible to realize various practical filter configurations with symmetric or asymmetric transmission characteristics.

Figure 9A:
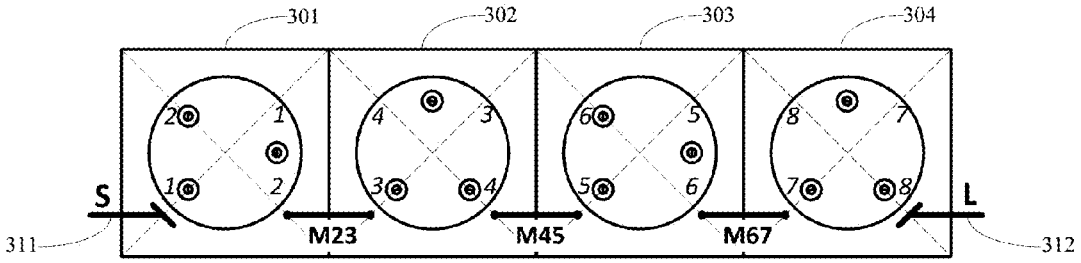
FIG. 9*a* is a schematic view of a dielectric resonator filter with four dielectric resonators according to embodiments of the present application.
Figure 9B:
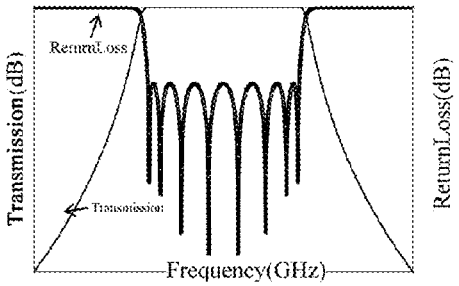
FIG. 9*b* is a plot of transmission response for the dielectric resonator filter of FIG. 9*a*.

FIG. 9*a* shows a filter including four resonators 301, 302, 303 and 304 positioned in a straight line layout, which provides an eight-pole symmetric filter characteristic. An input element 311 is disposed in the resonator 301 for inputting signals S to the filter and an output element 312 is disposed in the resonator 304 for outputting signals L from the filter. In this embodiment, one coupling element is provided between each of two adjacent resonators. Specifically, a coupling element $M_{23}$ is provided between the resonators 301 and 302, a coupling element $M_{45}$ is provided between the resonators 302 and 303, and a coupling element $M_{67}$ is provided between the resonators 303 and 304. In order to efficiently use the space of the metal cavity for realizing the couplings between two dielectric resonators and reduce the stray coupling between two metal cavities, in an embodiment, the two frequency tuning screws of a resonator cavity are placed along the two diagonal lines (i.e., dashed lines 1 and 2 for the resonator 301, dashed lines 3 and 4 for the resonator 302, dashed lines 5 and 6 for the resonator 303, and dashed lines 7 and 8 for the resonator 304) of the resonator cavity. FIG. 9*b* shows the transmission response for the dielectric resonator filter of FIG. 9*a*. The horizontal axis represents the frequency in GHz and the vertical axis represents the transmission in dB and the return loss in dB.

Figure 10A:
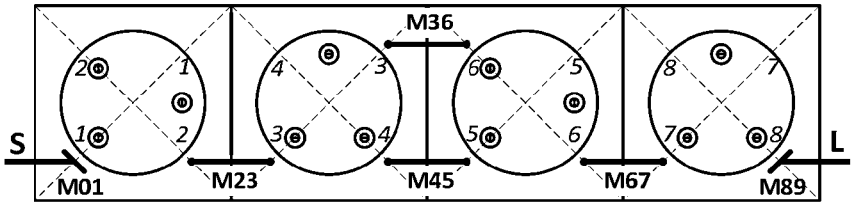
FIGS. 10*a*, 10*b*, 10*c* and 10*d* are schematic views showing four possible dielectric resonator filter layouts, respectively, with symmetric transmission responses according to embodiments of the present application.
Figure 10B:
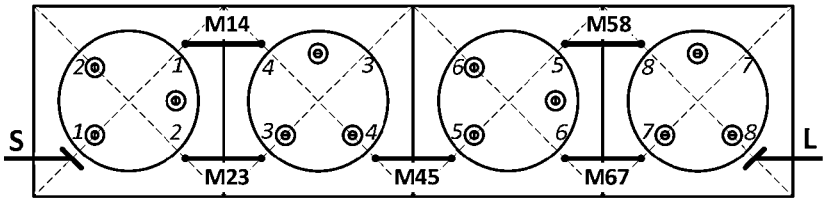
Figure 10C:
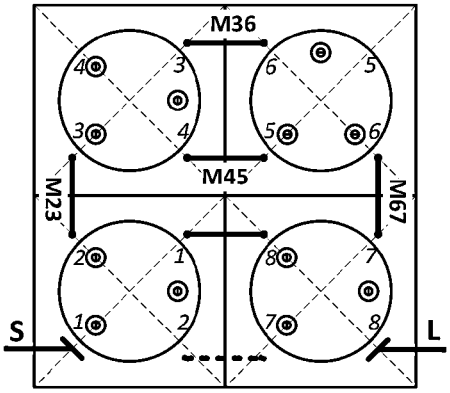
Figure 10D:
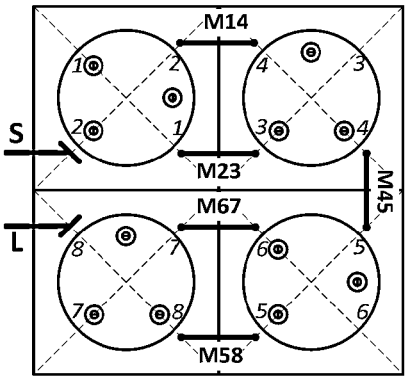
Figure 11A:
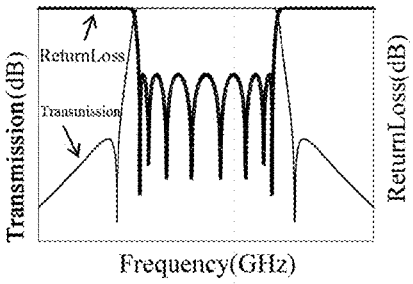
FIGS. 11*a*, 11*b*, 11*c* and 11*d* are plots of transmission response for the dielectric resonator filters of FIGS. 10*a*, 10*b*, 10*c* and 10*d*, respectively.
Figure 11B:
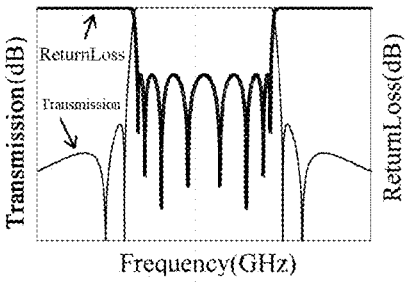
Figure 11C:
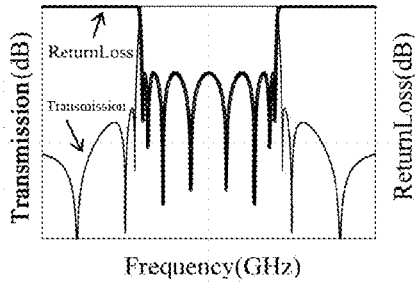
Figure 11D:
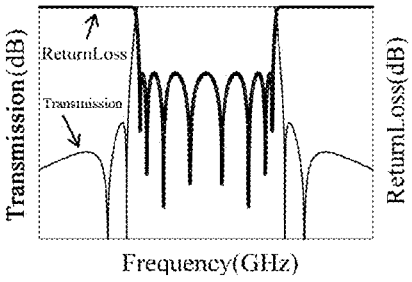

FIGS. 10*a*, 10*b*, 10*c* and 10*d* show several other practical layout schemes of an eight-pole symmetric filter. FIGS. 11*a*, 11*b*, 11*c* and 11 *d* are plots of transmission responses for the dielectric resonator filters of FIGS. 10*a*, 10*b*, 10*c* and 10*d*, respectively. The filters illustrated in FIGS. 10*a* and 10*b* are in a straight line layout while those in FIGS. 10*c* and 10*d* are in a folded layout. The filters in FIGS. 10*a* and 10*c* are in folded coupling topology, whereas those in FIGS. 10*b* and 10*d* are in cascade-quartet (CQ) coupling topology. In FIG. 10*a*, the coupling elements $M_{01}$, $M_{23}$, $M_{45}$, $M_{36}$, $M_{67}$ and $M_{89}$ are provided. In FIG. 10*b*, the coupling elements $M_{14}$, $M_{23}$, $M_{45}$, $M_{58}$ and $M_{67}$ are provided. In FIG. 10*c*, the coupling elements $M_{23}$, $M_{36}$, $M_{45}$, and $M_{67}$ are provided. In FIG. 10*d*, the coupling elements $M_{14}$, $M_{23}$, $M_{58}$, $M_{67}$ and $M_{45}$ are provided.

Figure 12A:
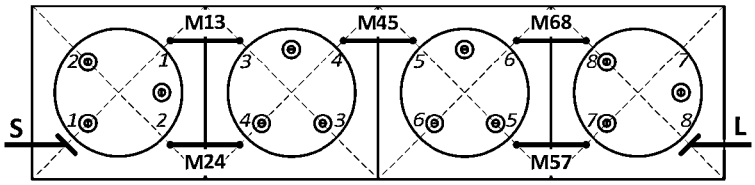
FIGS. 12*a*, 12*b*, 12*c* and 12*d* are schematic views showing four possible dielectric resonator filter layouts, respectively, with asymmetric transmission responses according to embodiments of the present application.
Figure 12B:
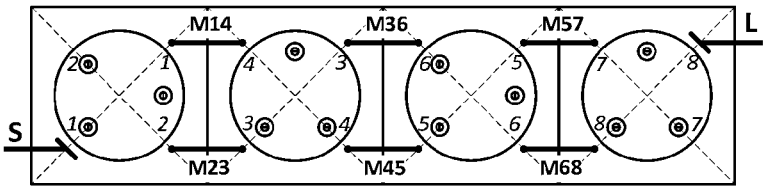
Figure 12C:
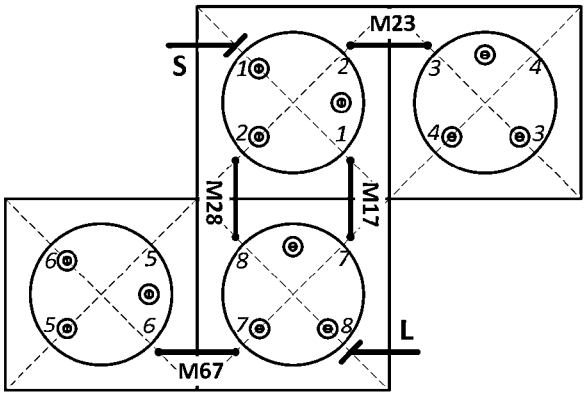
Figure 12D:
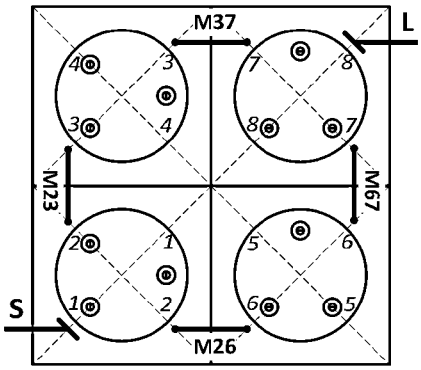
Figure 13A:
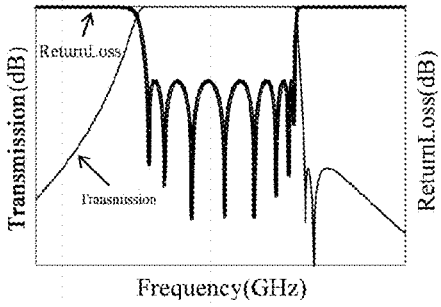
FIGS. 13*a*, 13*b*, 13*c* and 13*d* are plots of transmission response for the dielectric resonator filters of FIGS. 12*a*, 12*b*, 12*c* and 12*d*, respectively.
Figure 13B:
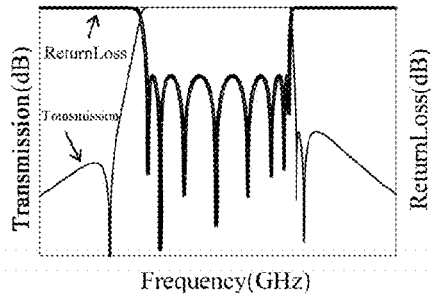
Figure 13C:
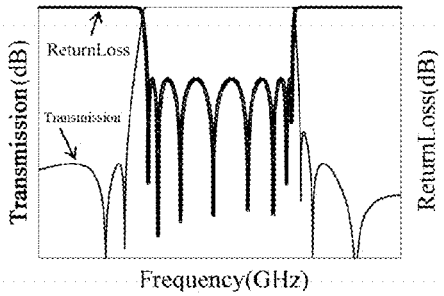
Figure 13D:
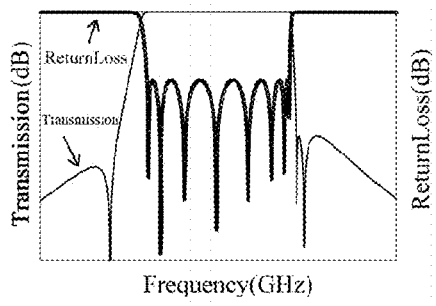

FIGS. 12*a*, 12*b*, 12*c* and 12*d* show several practical layout schemes of a filter including four resonators, which provides an eight-pole asymmetric filter characteristic. In FIG. 12*a*, the coupling elements $M_{13}$, $M_{24}$, $M_{45}$, $M_{57}$ and $M_{68}$ are provided. In FIG. 12*b*, the coupling elements $M_{14}$, $M_{23}$, $M_{36}$, $M_{455}$ $M_{57}$, and $M_{68}$ are provided. In FIG. 12*c*, the coupling elements $M_{23}$, $M_{17}$, $M_{28}$, and $M_{67}$ are provided. In FIG. 12*d*, the coupling elements $M_{23}$, $M_{37}$, $M_{67}$, and $M_{26}$ are provided. FIGS. 13*a*, 13*b*, 13*c* and 13*d* are plots of transmission responses for the dielectric resonator filters of FIGS. 12*a*, 12*b*, 12*c* and 12*d*, respectively. The filters in FIGS. 12*a* and 12*b* are in box and extended-box coupling topologies, and are capable of generating two and three independent transmission zeroes, respectively. The filters in FIGS. 12*c* and 12*d* are in Cul-de-Sac and further Cul-de-Sac coupling topologies, and can generate five and three independent transmission zeroes, respectively. When the $TM_{11}$ dual mode dielectric resonators are used for channel filters of a diplexer, filter characteristics with independently controllable asymmetric transmission zeroes are usually required.

Here, an example of an 8-pole symmetric filter in a folded coupling topology with straight line layout as shown in FIG. 10*a* will be described in details. The center frequency $f_0$ and bandwidth BW for the filter is 1.948 GHz and 67 MHz, respectively. Four dielectric resonators with radius R=16.2 mm, relative permittivity $\in_r$=20.5 and loss tangent $2.5\times10^{-5}$ are used to build the filter. For each metal cavity the inner size is 41×41×14(L×L×H) $mm^3$. The coupling matrix which gives a 20 dB return loss and two 60 dB side lobe filter characteristic is synthesized with a standard procedure and given in Table I. As shown in Table I, $M_{01}$ ($M_{89}$) is the input (output) coupling, respectively. $M_{23}$, $M_{45}$, $M_{67}$ are the inter-cavity mainline couplings, which are realized by metal loops. $M_{12}$, $M_{34}$, $M_{56}$ and $M_{78}$ (not labeled) are the dual degenerate mode mainline couplings in dual mode dielectric resonators, respectively. The dual degenerate mode mainline couplings are realized by the coupling screws inserted into the dielectric rods.

TABLE I

| COUPLING MATRIX FOR THE 8-POLE FOLDED-COUPLED FILTER | |
|---|---|
| $M_{01}$ | 0.9882 |
| $M_{12}$ | 0.8178 |
| $M_{23}$ | 0.5877 |
| $M_{34}$ | 0.5393 |
| $M_{36}$ | −0.1014 |
| $M_{45}$ | 0.6376 |
| $M_{56}$ | 0.5393 |
| $M_{67}$ | 0.5877 |
| $M_{78}$ | 0.8178 |
| $M_{89}$ | 0.9882 |

Figure 14A:
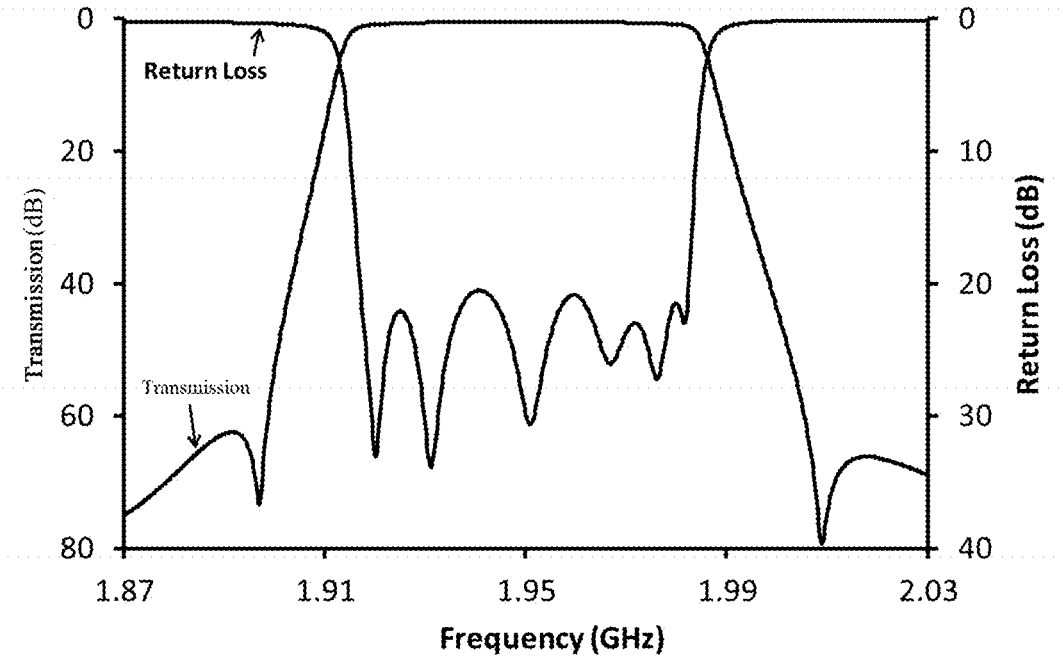
FIG. 14*a* is a plot showing a typical measured in-band transmission response for an 8-pole $TM_{11}$ dual mode dielectric resonator filter according to an embodiment.
Figure 14B:
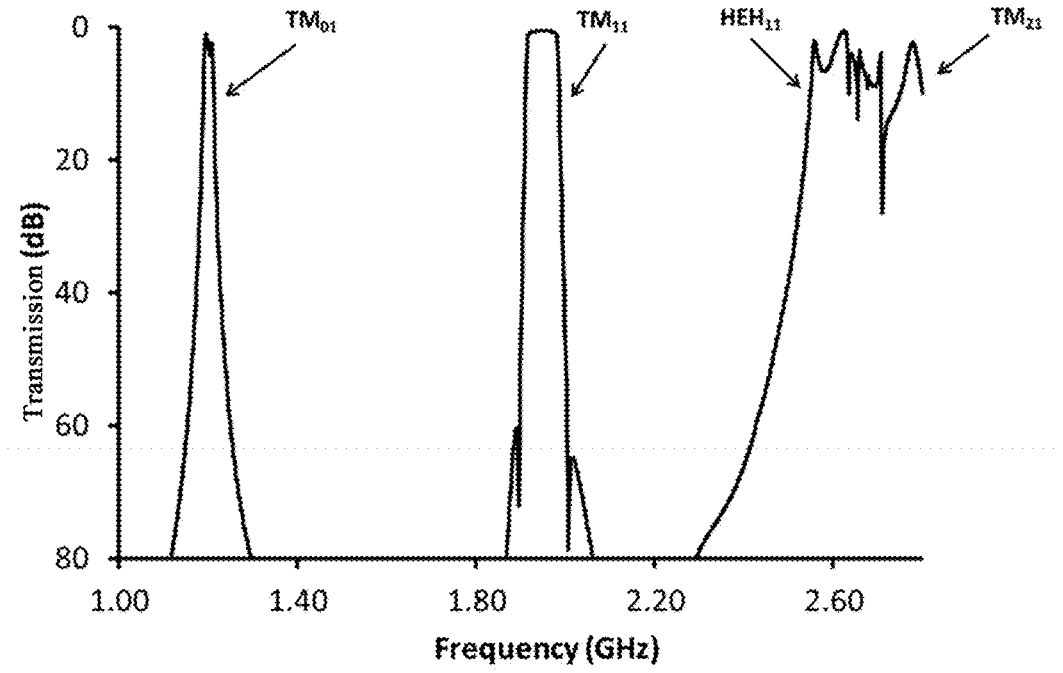
FIG. 14*b* is a plot showing a typical measured broadband transmission response for an 8-pole $TM_{11}$ dual mode dielectric resonator filter according to an embodiment.

The designed filter is measured. The measured in-band transmission/return loss responses of the filter are shown in FIG. 14*a* and the measured broadband transmission response of the filter is shown in FIG. 14*b*. The measured transmission loss at $f_0$ is less than 0.5 dB. From the broadband response of the filter shown in FIG. 14*b*, it can be observed that the lower spurious mode $TM_{01}$ is below 1.25 GHz, the higher spurious mode $TM_{21}$ is above 2.55 GHz, and the mode $TM_{11}$ is between the lower spurious mode $TM_{01}$ and the higher spurious mode $TM_{21}$. To increase the spurious mode free frequency band, these two spurious modes can be suppressed by cascading a wide band bandpass filter.

In an embodiment, the lower $TM_{01}$ spurious mode can also be suppressed by a self-contained method, in which the spurious mode can be suppressed by introducing a hole at the center of each dielectric resonator and a tuning screw inserted into the hole.

Figure 15:
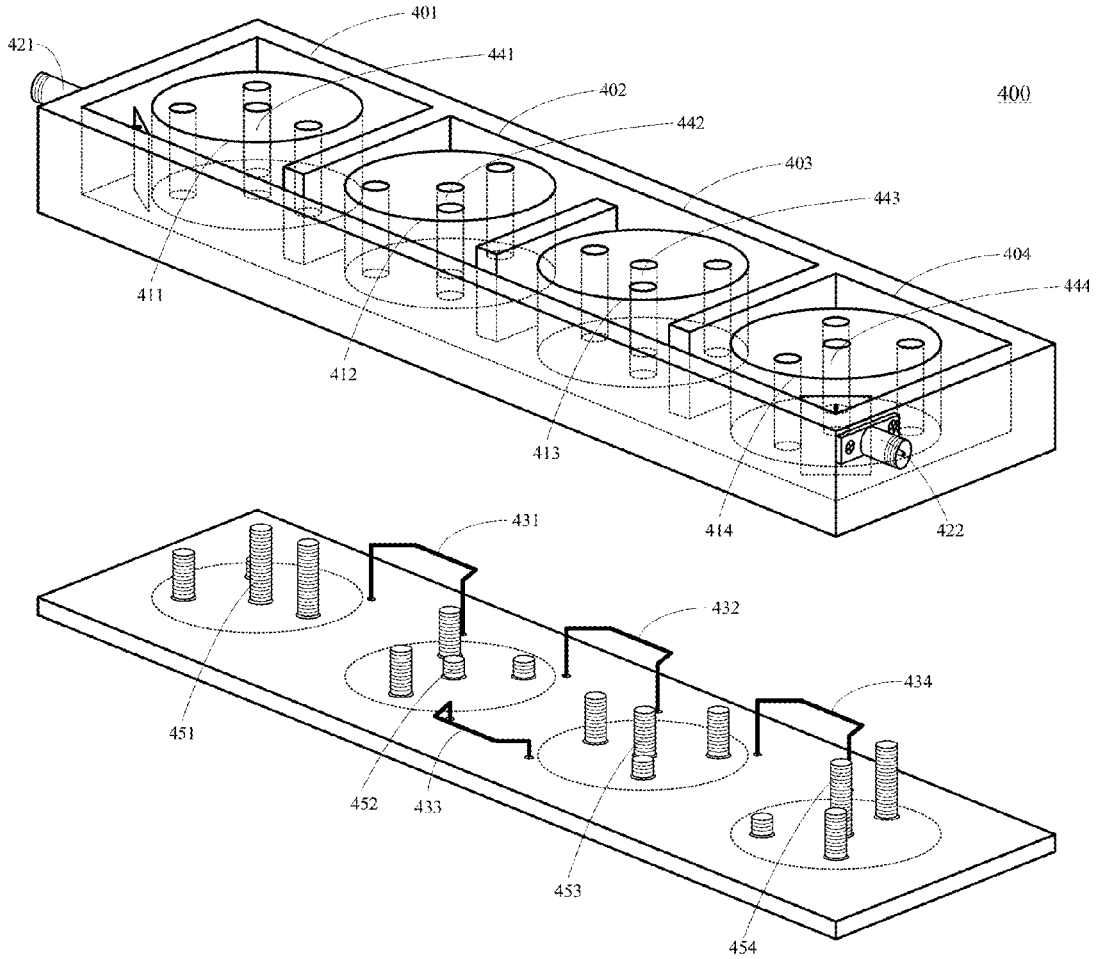
FIG. 15 is a perspective view of a dielectric resonator filter according to an embodiment of the present application.

FIG. 15 is a perspective view of a dielectric resonator filter 400 according to an embodiment of the present application. The filter 400 includes four resonators 401, 402, 403 and 404 positioned in a straight line layout, which provides an 8-pole symmetric filter characteristic. The resonators 401, 402, 403 and 404 include dielectric rods 411, 412, 413 and 414, respectively. An input element 421 is disposed in the resonator 401 for inputting signals to the filter and an output element 422 is disposed in the resonator 404 for outputting signals from the filter. In the embodiment, a coupling element 431 is provided between the resonator 401 and the resonator 402, two coupling elements 432, 433 are provided between the resonator 402 and the resonator 403, and a coupling element 434 is provided between the resonator 403 and the resonator 404. Each of the dielectric rods includes one coupling screw hole for accommodating coupling screw and two tuning screw holes for accommodating tuning screws.

Figure 16:
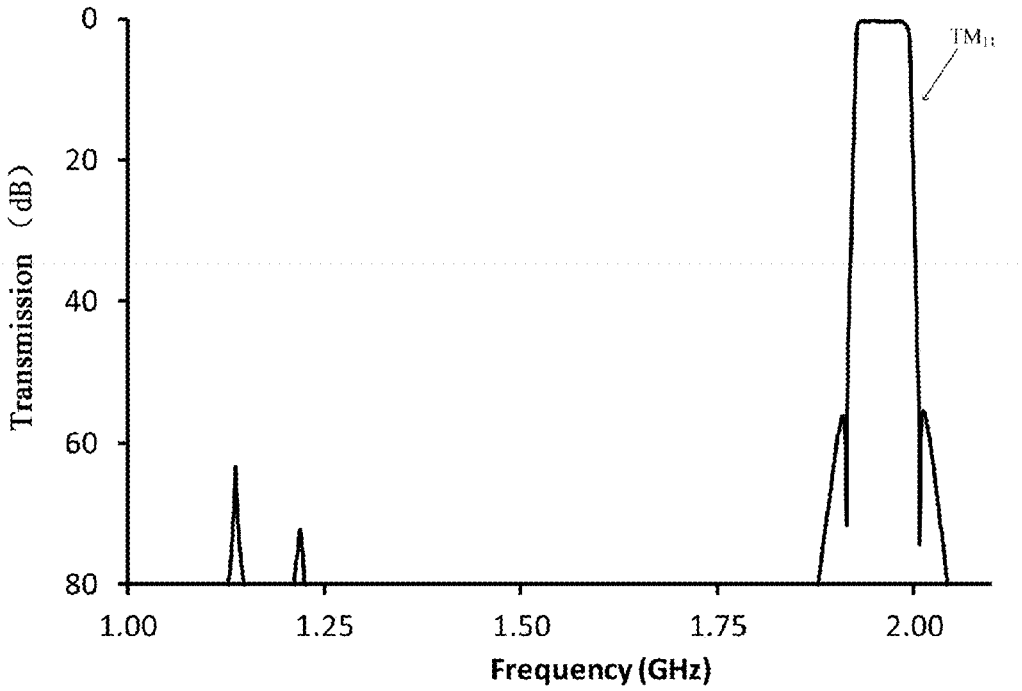
FIG. 16 is a plot showing a broadband transmission response for an 8-pole $TM_{11}$ dual mode dielectric resonator filter with spurious-suppression screws according to an embodiment.

In order to suppress the spurious mode $TM_{01}$ mode, as shown in FIG. 15, four holes 441, 442, 443 and 444 are formed at the center of each dielectric rods 411, 412, 413 and 414 for accommodating tuning screws 451, 452, 453 and 454, respectively. By adjusting insertion of the central tuning screws to different depths for the four resonators, the lower $TM_{01}$ spurious resonance frequency in each dielectric resonator will be different and will be spread in a broad frequency range so that very weak signal carried by $TM_{01}$ mode can pass through the filter. The suppression effect by this method has been demonstrated in FIG. 16, where more than 60 dB suppression of the spurious mode signal can be achieved.

In an embodiment, the dimension of the resonator cavity can be chosen by trading off the spurious mode location ($HEH_{11}$ as shown in FIG. 14*b*) and the Q value of the resonator. For example, as shown in FIGS. 2*b* and 2*c*, the side length L (FIG. 2*c*) of the square cavity as well as the height h of the cavity can be chosen by trading off the spurious mode location and the Q value of the $TM_{11}$ dual-mode dielectric resonator, wherein "d" (FIG. 2*b*) is the diameter of the cylindrical dielectric resonator.

In a communication system, especially in a modern wireless base station system, integrated diplexer/multiplexers are widely used due to the stringent footprint/space/mass requirement.

Figure 17:
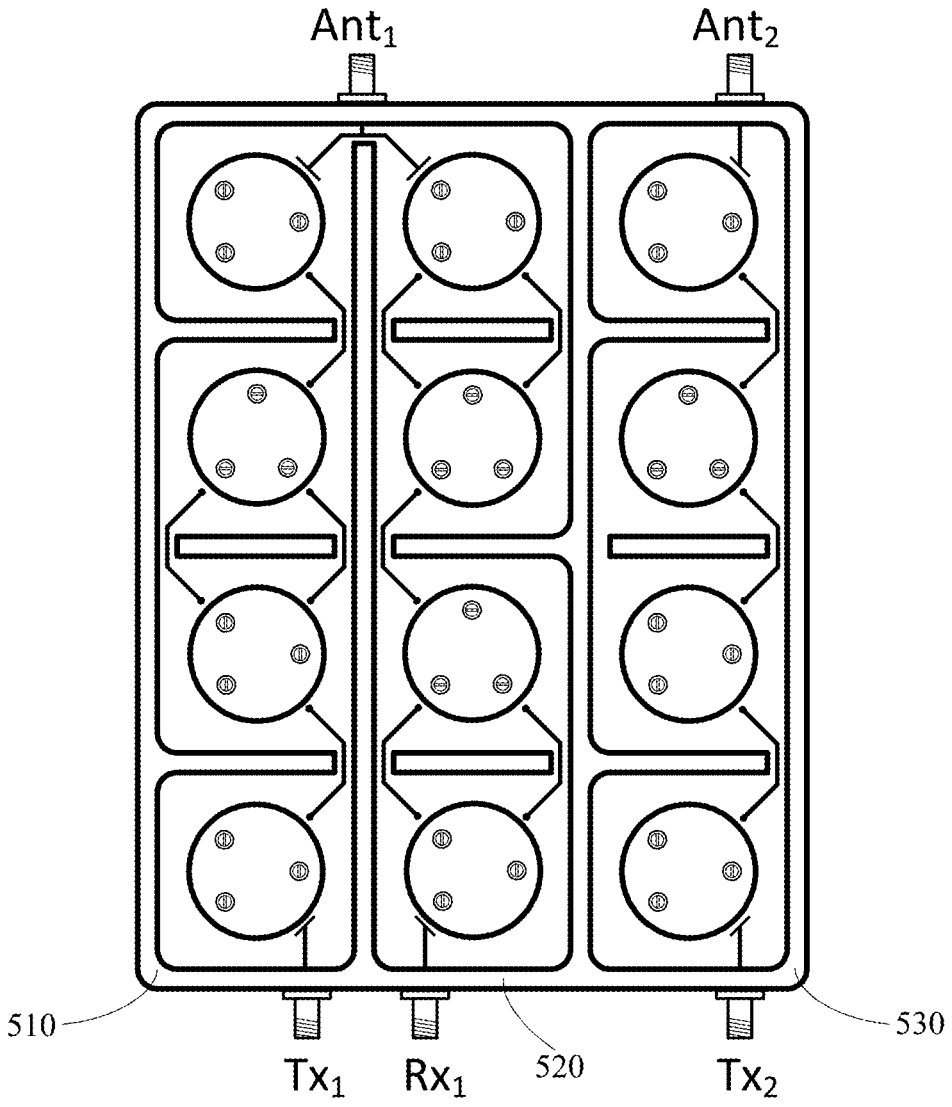
FIG. 17 is a plan view of a diplexer/filter configuration by the $TM_{11}$ dual-mode dielectric resonators according to an embodiment of the present application.

According to an embodiment, an integrated diplexer/multiplexer can be realized by using the proposed filter. FIG. 17 shows a diplexer including three 8-pole single filters 510, 520, 530. Each of the filters includes four dielectric resonators positioned in a straight line layout. The filter 530 has two ports: $Ant_e$ and $Tx_2$. The filters 510 and 520 form two channels of a diplexer with port $Ant_1$ as the common port, ports $Tx_1$ and $Rx_1$ as the other two ports. Being realized by the proposed dual mode resonator, the structure of the diplexer/multiplexer is compact. Since all the tuning and coupling elements are easily accessed from the top surface, rather than from the side walls, the tuning and coupling of the diplexer/filter is also convenient. Such dual mode resonator configuration easily enables the integration of even more filters laid on the horizontal plane.

Figure 18:
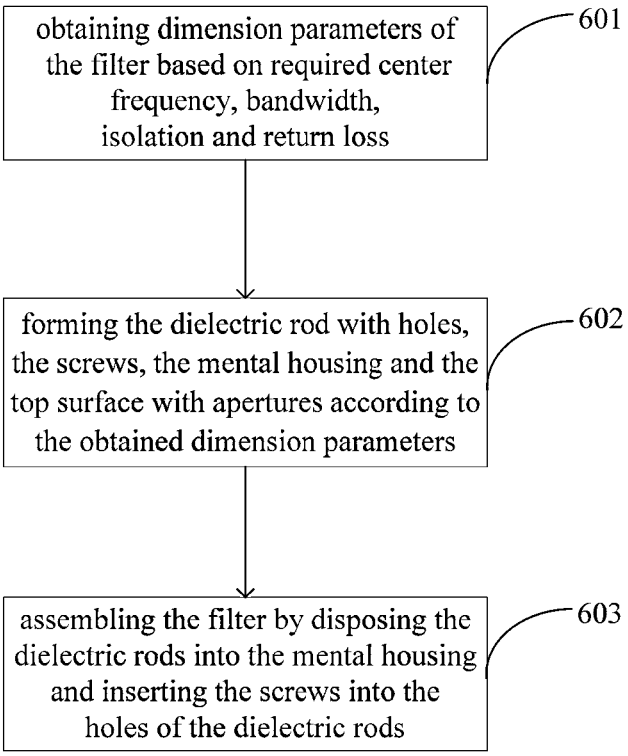
FIG. 18 is a flowchart of manufacturing a dielectric resonator filter including at least one dielectric resonator according to an embodiment of the present application.

According to an embodiment, a method of manufacturing a dielectric resonator filter including at least one dielectric resonator is provided. As shown in FIG. 18, dimension parameters of the $TM_{11}$ dual-mode dielectric rod and the metal housing of the filter are obtained based on required center frequency, bandwidth, transmission and return loss in step 601. In an embodiment, a filter circuit model can be built up by using EM simulation software, for example, HFSS, and the dimension parameters can be obtained according the circuit model and the tradeoff between filter volume, Q-factor, spurious mode frequencies. In step 602, the dielectric rod with holes, the screws, the metal housing and the top surface with apertures are formed according to the obtained dimension parameters. In step 603, the filter is assembled by disposing the dielectric rods into the metal housing and inserting the screws into the holes of the dielectric rods. The dielectric resonator filter supports dual $TM_{11}$ degenerate modes, each of which forms a resonant circuit, and an insertion depth of each of the screws is adjustable for adjusting resonance frequencies of the dual degenerate modes and coupling between the dual degenerate modes.

In an embodiment, an input/output connector is formed in the filter for input/output coupling of the dielectric resonator filter.

In an embodiment, a coupling element is formed between two adjacent dielectric resonators for coupling the two adjacent dielectric resonators.

In an embodiment, a spurious-suppressing hole is formed at the center of the dielectric rod.

This application presents a compact dielectric resonator filter/multiplexer using $TM_{11}$ dual-mode dielectric resonators. The resonator is suitable for a planar coupling configuration and effective heat dissipation. High Q dielectric resonator filters with versatile coupling schemes can be achieved using the proposed dual mode resonators and coupling mechanism. The tuning screws inserted into the holes in dielectric resonators can effectively control the required coupling of the two degenerate modes and the frequency-offsets. The transmission responses of the filter/multiplexer are adjustable through the insertion depths of the screws and metal coupling loops.

While the present application has been illustrated by the above description and embodiments or implementations, it is not intended to restrict or in any way limit the scope of the appended claims hereto.

What is claimed is:

1. A dielectric resonator filter including at least one dielectric resonator, the dielectric resonator comprising:

a metal housing having a top surface and a bottom surface and defining a resonator cavity;

a dielectric rod located within the resonator cavity, wherein the dielectric rod is short-circuited at both the top surface and the bottom surface;

a plurality of holes formed in the dielectric rod parallel to an axis of the dielectric rod and a plurality of apertures formed on the top surface corresponding to the positions of the holes, respectively; and a plurality of screws is inserted into the holes through the apertures, respectively;

wherein the dielectric resonator supports dual $TM_{11}$ degenerate modes, each of which forms a resonant circuit, and an insertion depth of each of the screws is adjustable to adjust resonance frequencies of the dual degenerate modes and coupling between the dual degenerate modes, wherein a length of the resonator cavity and a height of the resonator cavity are based on a spurious mode location and a Q value of the resonator filter.

2. The filter of claim 1, wherein the plurality of holes further include a spurious-suppressing hole located at the center of the dielectric rod.

3. The filter of claim 2, wherein the plurality of screws further include a spurious-suppressing screw inserted into the spurious-suppressing hole for suppressing the spurious mode.

4. The filter of claim 1, wherein the dielectric rod is a square dielectric rod situated in the center of a square resonator cavity.

5. The filter of claim 1, wherein the dielectric rod is a cylindrical dielectric rod situated in the center of a cylindrical resonator cavity.

6. The filter of claim 1, wherein the plurality of holes are located at a substantively equal radius from a center of the dielectric rod.

7. The filter of claim 1, wherein the plurality of screws comprise:

at least one coupling screw inserted into at least one of the plurality of holes functioning as a coupling hole for adjusting the coupling between the dual degenerate modes;

at least one tuning screw inserted into at least another one of the plurality of holes function as a tuning hole for adjusting the resonance frequency of one of the dual degenerate modes; and at least one tuning screw inserted into at least a further one of the plurality of holes functioning as another tuning hole for adjusting the resonance frequency of the other one of the dual degenerate modes.

8. The filter of claim 1, wherein the plurality of holes include one coupling screw hole, a first tuning screw hole, and a second tuning screw hole.

9. The filter of claim 8, wherein the plurality of screws comprises:

a coupling screw inserted into the coupling screw hole for adjusting the coupling between the dual degenerate modes; and a first tuning screw inserted into the first tuning screw hole for adjusting a resonance frequency of one of the dual degenerate modes; and a second tuning screw inserted into the second tuning screw hole for adjusting a resonance frequency of the other one of the dual degenerate modes.

10. The filter of claim 1, wherein the filter comprises an input/output element for input/output coupling to/from the filter.

11. The filter of claim 10, wherein the input/output element includes a connector, an input/output coupling strip, and a wire, wherein the input/output coupling strip includes an end connected to the connector through the wire and another end grounded to the bottom surface.

12. The filter of claim 1, wherein the filter comprises a coupling element for coupling between two adjacent dielectric resonators.

13. The filter of claim 12, wherein the coupling element comprises a conductor loop including a metal wire with two ends short-circuited to an upper surface of the resonator cavity.

14. The filter of claim 13, wherein the metal wire is folded in a trapezoid shape.

15. The filter of claim 13, wherein the coupling between two adjacent dielectric resonators is adjustable by adjusting a height of the loop.

16. An integrated diplexer/multiplexer comprising a plurality of dielectric filters according to claim 1.

17. A dielectric resonator filter including a plurality of dielectric resonators in a common housing, wherein the housing includes a top surface and a bottom surface, a separating wall is provided between each of two adjacent dielectric resonators to separate the housing into a plurality of resonator cavities, and a coupling element is provided for coupling between two adjacent dielectric resonators, wherein each of the dielectric resonators comprises:

a dielectric rod located within the resonator cavity of the dielectric resonator, wherein the dielectric rod is short-circuited at both the top surface and the bottom surface;

a plurality of holes are formed in the dielectric rod parallel to an axis of the dielectric rod and a plurality of apertures are formed on the top surface corresponding to the positions of the holes, respectively; and a plurality of screws are inserted into the holes through the apertures, respectively;

wherein each of the dielectric resonators supports dual $TM_{11}$ degenerate modes, each of which forms a resonant circuit, and an insertion depth of each of the screws is adjustable to adjust resonance frequencies of the dual degenerate modes and coupling between the dual degenerate modes, wherein a length of the resonator cavity and a height of the resonator cavity are based on a spurious mode location and a Q value of the resonator filter.

18. The filter of claim 17, wherein a spurious-suppressing hole is formed at the center of the dielectric rod of each of the plurality of dielectric resonators, to accommodate a respective spurious-suppressing screw inserted into the corresponding spurious-suppressing hole, in which the insertion depth of the spurious-suppressing screw of each of the plurality of dielectric resonators is adjustable to suppress the spurious mode.

19. The filter of claim 17, wherein the dielectric resonator filter comprises four dielectric resonators which provides an 8-pole symmetric filter characteristic.

20. The filter of claim 17, wherein the dielectric resonator filter comprises four dielectric resonators which provides an 8-pole asymmetric filter characteristic.

21. The filter of claim 17, wherein the dielectric resonator filter comprises four dielectric resonators in a straight line layout.

22. The filter of claim 17, wherein the dielectric resonator filter comprises four dielectric resonators in a folded layout.

23. A method of manufacturing a dielectric resonator filter including at least one dielectric resonator, comprising:

obtaining dimension parameters of a dielectric rod and a metal housing, having a top surface and a bottom surface and defining a resonator cavity in between, of a filter based on required center frequency, bandwidth, isolation and return loss;

forming a plurality of holes in the dielectric rod parallel to an axis thereof, the holes sized and dimensioned to receive respective ones of a plurality of screws, and a plurality of apertures in the top surface of the metal housing, all according to the obtained dimension parameters; and assembling the filter by disposing the dielectric rods into the metal housing and inserting the screws into the respective holes of the dielectric rod, wherein the dielectric resonator filter supports dual $TM_{11}$ degenerate modes, each of which forms a resonant circuit, and an insertion depth of each of the screws is adjustable for adjusting resonance frequencies of the dual degenerate modes and coupling between the dual degenerate modes, wherein a length of the resonator cavity and a height of the resonator cavity are based on a spurious mode location and a Q value of the resonator filter.

24. The method of claim 23, comprising forming a spurious-suppressing hole at the center of the dielectric rod.

25. The method of claim 23, wherein the dielectric resonator filter comprises two or more dielectric resonators, and the method further comprises:

forming a coupling element between two adjacent dielectric resonators of the two or more dielectric resonators for coupling the two adjacent dielectric resonators.

26. The method of claim 23, comprising forming an input/output in the filter for input/output coupling to/from the dielectric resonator.

* * * * *